US005931699A

United States Patent [19]

Saito

[11] Patent Number: 5,931,699

[45] Date of Patent: Aug. 3, 1999

[54] WATERPROOF CONNECTOR

[75] Inventor: Hitoshi Saito, Shizuoka, Japan

[73] Assignee: Yazaki Corporation, Tokyo, Japan

[21] Appl. No.: 08/843,856

[22] Filed: Apr. 17, 1997

[30] Foreign Application Priority Data

Apr. 19, 1996 [JP] Japan ..... 8-098695

[51] Int. Cl.[6] ..... H01R 13/52

[52] U.S. Cl. ..... 439/587; 439/275

[58] Field of Search ..... 439/587, 589, 439/274, 275

[56] References Cited

U.S. PATENT DOCUMENTS

| | | | |
|---|---|---|---|
| 4,214,802 | 7/1980 | Otani et al. | 439/275 |
| 4,810,208 | 3/1989 | Hayes et al. | 439/589 |
| 5,613,868 | 3/1997 | Ohsumi et al. | 439/587 |
| 5,618,198 | 4/1997 | Sato et al. | 439/279 |

*Primary Examiner*—Neil Abrams
*Attorney, Agent, or Firm*—Armstrong, Westerman, Hattori, McLeland & Naughton

[57] ABSTRACT

A waterproof connector in which, even if tension caused by the bending of an electrical wire is applied to a sealing portion, the waterproofness of the sealing portion is improved without making the dimension and weight of a connector housing larger and heavier. The waterproof connector (A) according to the present invention comprises: a housing (B), a plurality of terminal accommodating cavities (1) in the housing (B), a waterproof plug (5) with a plurality of sealing through holes (7) at positions corresponding to those of the plurality of terminal accommodating cavities (1), a plug cover (6) integrally formed with the waterproof plug (5) to form a sealing portion (C) in combination with the waterproof plug (5). The plug cover (6) is arranged to be mounted to the housing (B), and has a plurality of through holes (8) at positions corresponding to those of the plurality of sealing through holes (7) of the waterproof plug (5). The waterproof connector (A) according to the present invention also comprises an electrical wire-sustaining portion (10) with resilience on an inner peripheral surface of each of the through holes (8) of the plug cover (5). Each wire-sustaining portion (10) may also include water extraction holes (12) and peripheral projections (11) which project in each of the through holes (8) of the plug cover (6) on their inner peripheral surface. Latches (15, 14) for holding the sealing portion (C) in a preliminary state may be used.

6 Claims, 6 Drawing Sheets

WATERPROOF CONNECTOR

BACKGROUND OF THE INVENTION

1. Field of the Invention

The present invention relates to a waterproof connector used for the connection of a wire harness or the like in an automobile.

2. Description of the Related Art

Conventionally, a waterproof connector 50 shown in FIG. 7 has proposed as a connector with which a waterproof plug made of rubber is integrally formed.

That is, in FIG. 7, the waterproof connector 50 includes a plug accommodating chamber 53 on a connector housing 51 in which a waterproof plug 52 is accommodated, and a number of terminal accommodating cavities 54 formed at the front portion of the plug accommodating chamber 53. Through the waterproof plug 52 are formed sealing through holes 55 at positions corresponding to those of the terminal accommodating cavities 54, and two rows of projections 56 are formed on the inner peripheral surface of the sealing through holes 55.

A plug cover 57 covers the waterproof plug 52 at the rear end portion of the connector housing 51 and is fixed thereto with an engagement hole of a resilient arm 58, which is formed on the peripheral wall of the plug cover 57, being engaged with an engagement projection 59, which is formed on the inner peripheral wall of the connector housing 51, to prevent the waterproof plug 52 from being dropped off. Further, the plug cover 57 is provided with through holes 60 at portions corresponding to those of the sealing through holes 55 of the waterproof plug 52.

A terminal metal fitting 62, which is connected to an electrical wire 61 in advance, is inserted into the through hole 60 from a rear portion of the connector housing 51 so as to pass the sealing through hole 55 of the waterproof plug 52. Then, a spacer 63 is inserted into through holes 51*a* which are formed at the front portion of the connector housing 51, and the terminal metal fitting 62 and a resilient locking arm 54*b* are engaged with each other to secure the terminal metal fitting 62 to the connector 50 through the first locking projection 63*a* and the second locking projection 63*b* of the spacer 63. As a result, a cylindrical electrical contact portion 62*a* of the terminal metal fitting 62 and an opening 54*a* at an end of the terminal accommodating cavity 54 are maintained to face to each other.

In case that the electrical wire 61 bends at a prescribed angle, 90 degrees for example, to generate tension under the condition illustrated as an electrical wire 61' also, in order to maintain the waterproofness of the waterproof connector 50, the width dl of the waterproof plug 52 should be widened, or the width d2 of the plug cover 57 should be increased to mitigate the tension caused by the electrical wire 61' at a sealing portion, that is, the waterproof plug 52 and the plug cover 57.

However, in the conventional waterproof connector 50, to mitigate the tension caused by the electrical wire 61' at the sealing portion, it is required to increase the width d1 of the waterproof plug 52 and the width d2 of the plug cover 57, which causes problems that the dimension and weight of the connector housing 51 become larger and heavier.

SUMMARY OF THE INVENTION

The present invention has been made in consideration of the aforementioned problems, and the object thereof is to provide a waterproof connector in which even if tension caused by the bending of an electrical wire is applied to a sealing potion, the waterproofness of the sealing portion is improved without making the dimension and weight of a connector housing larger and heavier.

To accomplish the above-mentioned object, a waterproof connector according to the present invention comprises: a housing; a plurality of terminal accommodating cavities in the housing; a waterproof plug with a plurality of sealing through holes at positions corresponding to those of the plurality of terminal accommodating cavities; a plug cover integrally formed with the waterproof plug to form a sealing portion in combination with the waterproof plug, the plug cover having a plurality of through holes at positions corresponding to those of the plurality of sealing through holes of the waterproof plug, the plug cover to be mounted to the housing; and an electrical wire sustaining portion with resilience on an inner peripheral surface of each of the through holes of the plug cover.

The waterproof connector described above may further comprising: a preliminary locking means for preliminarily locking the sealing portion to the housing, and a terminal metal fitting is inserted into and fixed to the terminal accommodating cavity after passing through the sealing through hole of the waterproof plug and the through hole of plug cover under a condition that the sealing portion is preliminarily locked to the housing.

Further, in the aforementioned waterproof connector, the preliminary locking means may comprises: a locking arm with a first locking projection at a tip thereof; and a second locking projection formed on the sealing portion, the second locking projection engaging the first locking projection when the sealing portion is preliminarily locked to the housing.

Still further, the waterproof connector described above may further comprises a spacer for fixing the terminal metal fitting to the terminal accommodating cavity, the spacer preliminarily locked to the housing before the terminal metal fitting is inserted into the terminal accommodating cavity.

In the above-mentioned waterproof connector, the electrical wire sustaining portion can include a row of projection which is formed around and near an inlet of the through hole.

Further, in the above the waterproof connector, the electrical wire sustaining portion may have a water extractor extending in a direction that the terminal metal fitting is inserted into the through hole.

BRIEF DESCRIPTION OF THE DRAWINGS

The present invention will be more apparent from the ensuring description with reference to the accompanying drawings wherein.

DETAILED DESCRIPTION OF PREFERRED EMBODIMENTS

Now, a waterproof connector according to an embodiment of the present invention will be explained with reference to drawings.

In FIGS. 1 to 6, a waterproof connector according to an embodiment of the present invention is illustrated. In those figures, like components and elements as the conventional waterproof connector described above have like names, and detailed explanation thereof will be omitted.

Figure 1:
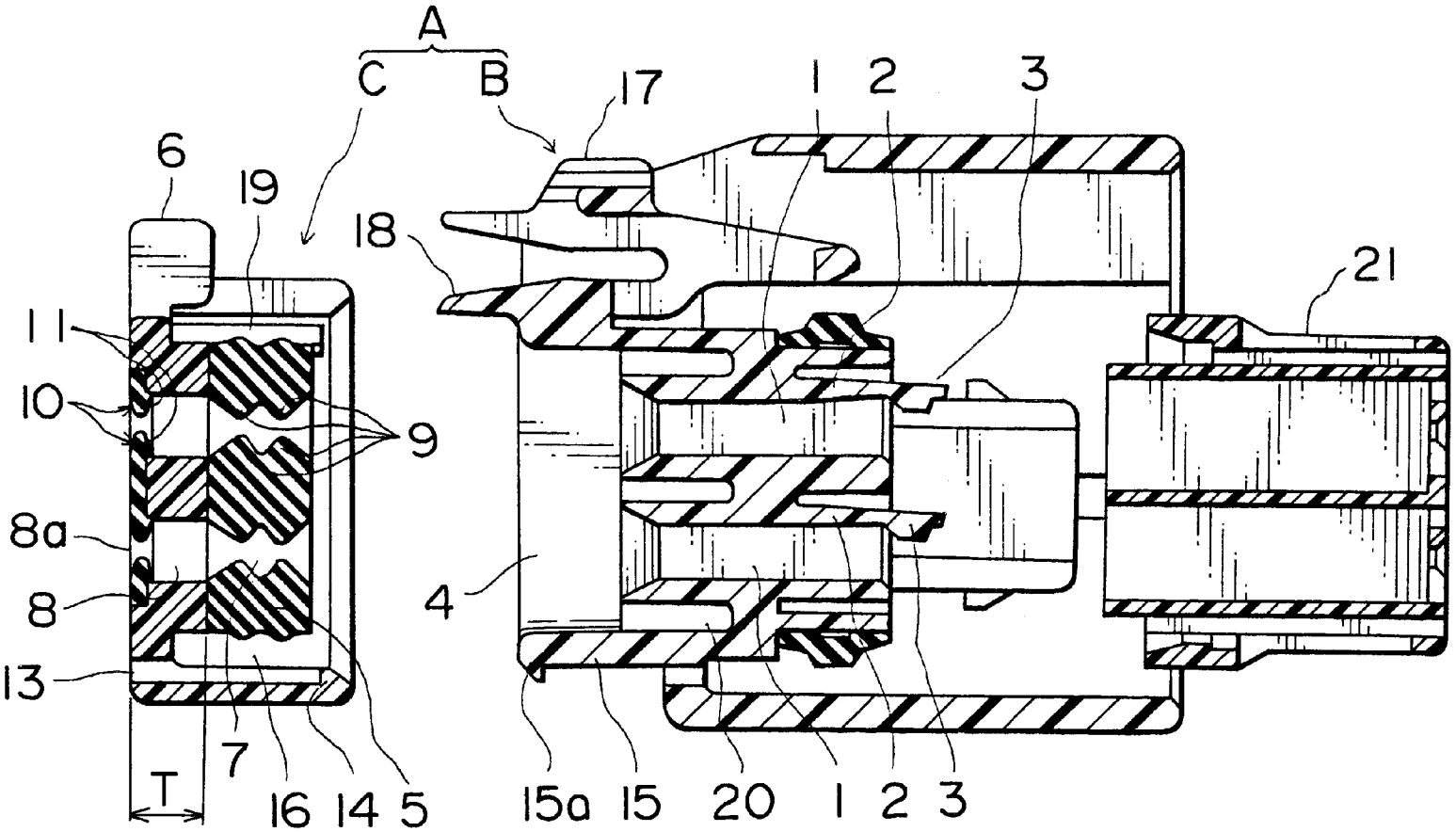
FIG. 1 is a lateral cross-sectional view of a waterproof connector according to an embodiment of the present invention.

In FIG. 1, the waterproof connector A comprises a connector housing B, and a sealing portion C which is engaged with the rear end portion of the connector housing B.

The connector housing B is provided with a plurality of terminal accommodating cavities 1 which penetrate inner portion of the connector housing B and extend in a direction that a terminal is inserted. With the upper wall 2 of each of the terminal accommodating cavities 1 is integrally formed a resilient locking arm 3 with a shape of a cantilever. At the rear portion of the connector housing B is formed an accommodating chamber 4 for the sealing portion C.

The sealing portion C includes a waterproof plug 5 made of rubber resilient member, and a plug cover 6 which receives the waterproof plug 5 and is accommodated in the accommodating chamber 4, and the waterproof plug 5 and the plug cover 6 are integrally formed with each other. The waterproof plug 5 is provided with sealing through holes 7, which penetrate the body of the waterproof plug 5 in the direction that a terminal is inserted, at portions corresponding to those of the terminal accommodating cavities 1. Further, the plug cover 6 is also provided with through holes 8, which penetrated the body of the plug cover 6 in the direction that a terminal is inserted, at portions corresponding to those of the sealing through holes 7.

On the inner peripheral surface of the sealing through holes 7 are formed two rows of projections 9.

On the inner peripheral surface of the through holes 8 is formed an electrical wire sustaining portion 10 made of a rubber resilient member. The electrical wire sustaining portion 10 is positioned within an area T from an inlet 8*a* to the sealing through hole 7, preferably on the inner peripheral surface of the through hole 8 and in the vicinity of the inlet 8*a*. The shape of the electrical wire sustaining portion 10 is selected, in this embodiment, to form a peripheral row of projection 11 projecting inwardly on the inner peripheral surface of each of the through holes 8.

A plurality rows of the projections 11 may be formed on the inner peripheral surface. In place of the projection 11 with the shape described above, the electrical wire sustaining portion 10 may have a polygonal cross section such as triangle and rectangular cross sections. Further, it is possible to make the outer peripheral surface of the projection 11 uneven.

In this embodiment, the waterproof plug 5 and the electrical wire sustaining portion 10 are provided separately from each other, however, those members can integrally be formed with each other.

Figure 2:
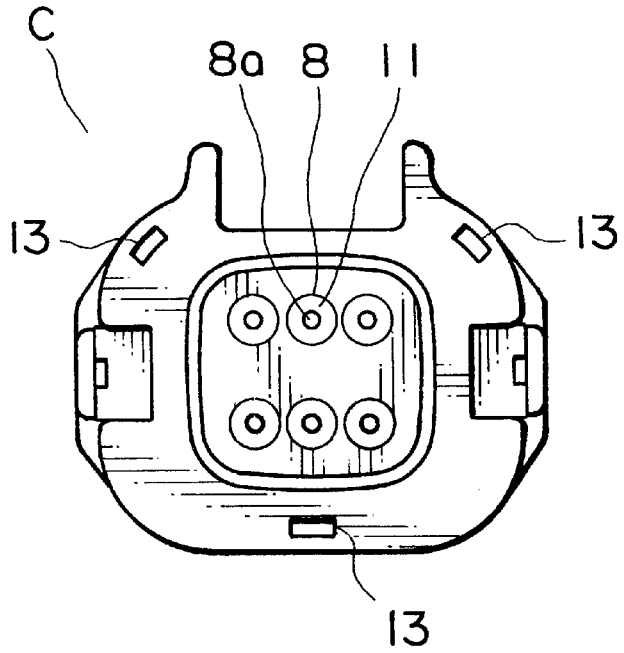
FIG. 2 is a front view of a sealing portion of the waterproof connector shown in FIG. 1.
Figure 3:
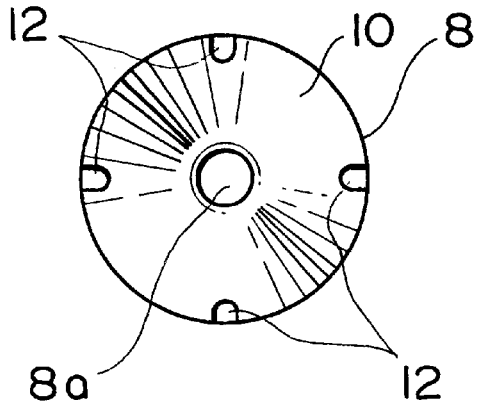
FIG. 3 is an enlarged view of a primary portion of the sealing portion shown in FIG. 2.

Referring to FIGS. 1 and 2, the plug cover 6 is provided with guide channels 13 which penetrates the plug cover 6 in the direction that a terminal is inserted, and in the guide channel 13 stands a locking projection 14. Between the guide channel 13 and the waterproof plug 5 is formed an arm accommodating cavity 16 for accommodating a locking arm 15 of the connector housing B. Further, as illustrated in FIG. 3, a water extractor 12 for removing water and the like which invades the through hole 8 may be formed on the electrical wire sustaining portion 10 so as to extend in the direction that a terminal is inserted.

Figure 4:
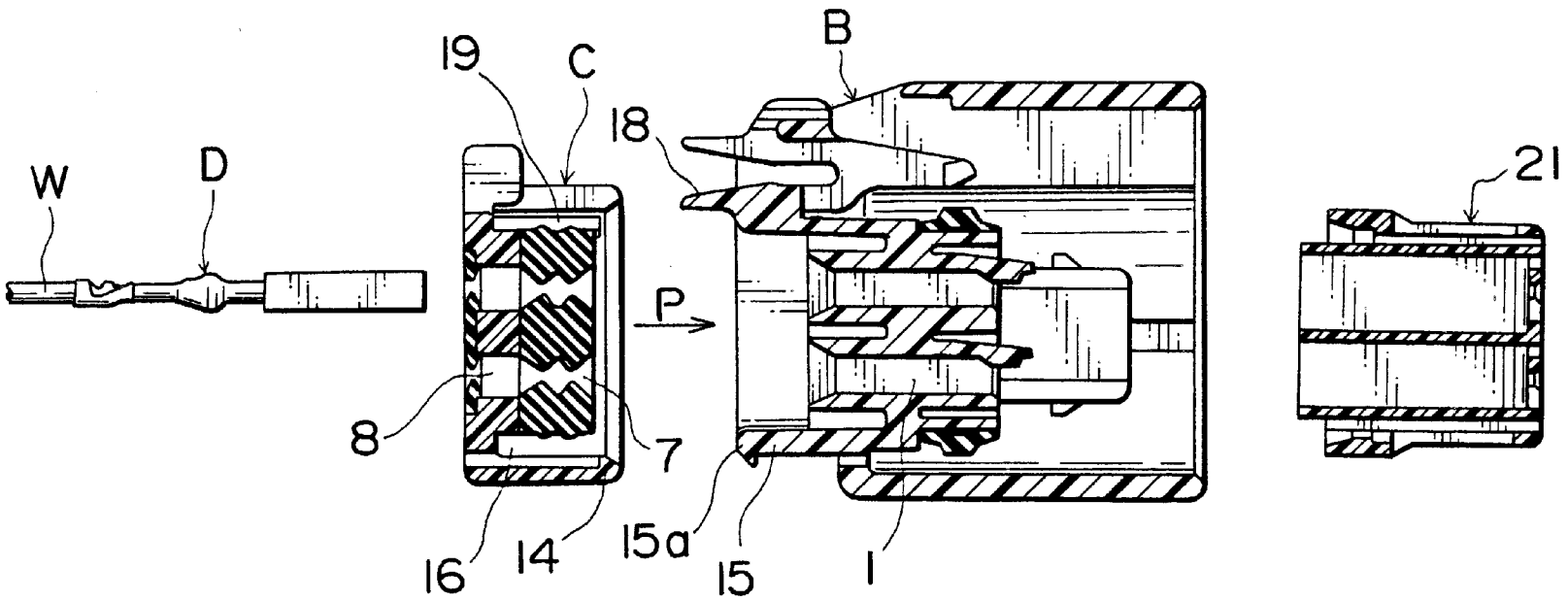
FIG. 4 is a view for explaining a condition prior to mounting the sealing portion to a connector housing of the waterproof connector.

Referring to FIG. 1, the connector housing B is provided with a projection wall 18 for preventing an electrical wire W shown in FIG. 4 and the like from catching a locking arm 17, and a space 19 for accommodating the projection wall 18 is provided between the inner peripheral surface of the plug cover 6 and the waterproof plug 5.

Next, an operation in which that a terminal metal fitting D is inserted into the terminal accommodating cavity 1 after the sealing portion C is mounted to the connector housing B, will be explained.

At first, as illustrated in FIG. 4, the sealing portion C is moved in a direction that is indicated by the arrow mark P under the condition that the center line of the sealing through hole 7 and the through hole 8 of the sealing portion C and that of the terminal accommodating cavity 1 of the connector housing B coincide with each other.

Then, the locking arm 15 is inserted into the arm accommodating cavity 16, and the projection wall 18 is inserted into the space 19 to engage a projection 15*a* at the tip of the locking arm 15 and the locking projection 14 with each other, which provides a preliminarily locked state of the sealing portion C to the connector housing B. Further, the spacer 21 is inserted into the connector housing B so as to be in a preliminarily locked state shown in FIG. 5.

Figure 5:
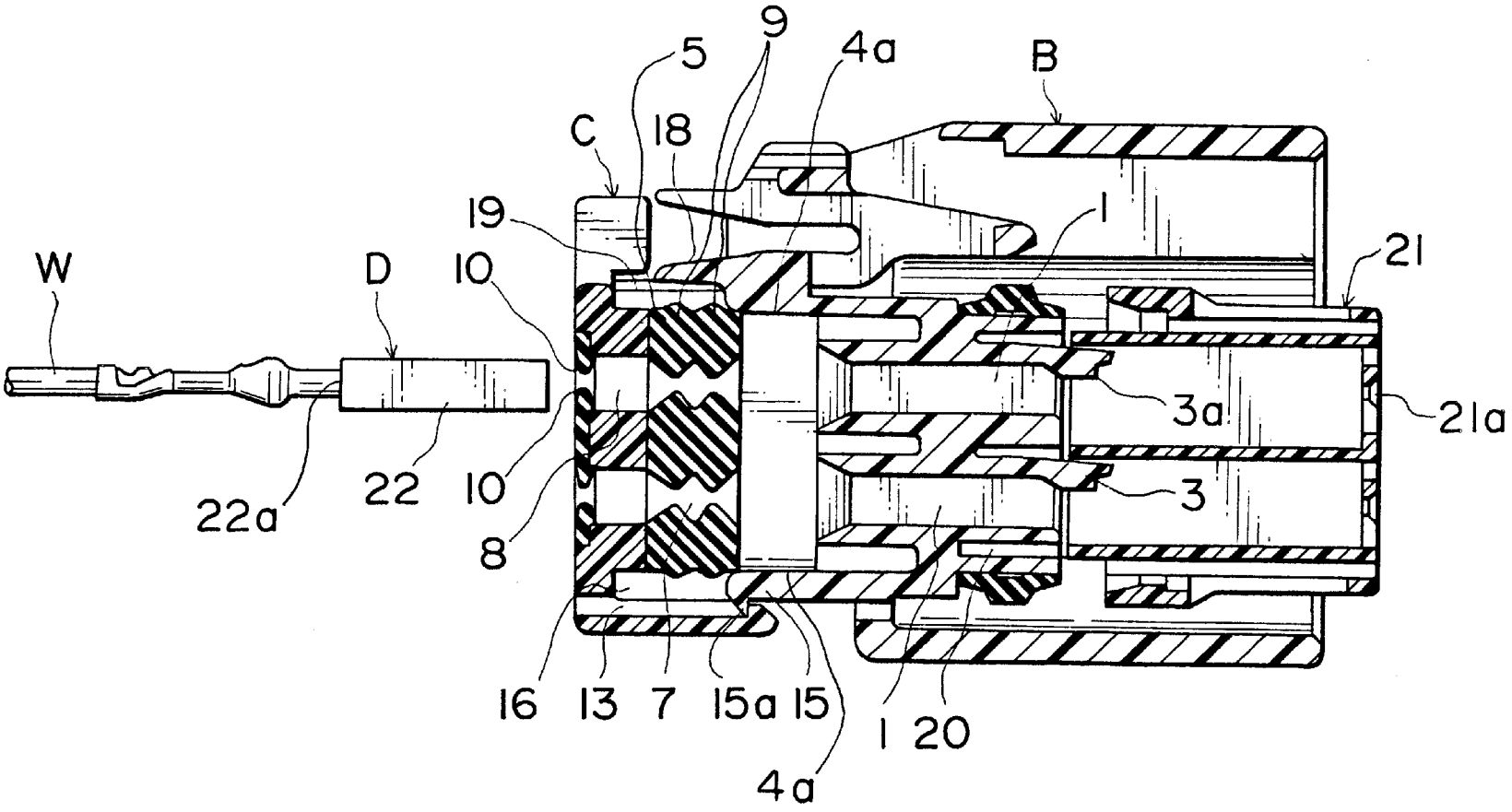
FIG. 5 is a view for explaining a condition prior to inserting a terminal metal fitting to the waterproof connector in which the sealing portion is preliminarily locked to the connector housing.

Referring to FIG. 5, then, the terminal metal fitting D is moved in the direction of P, shown in FIG. 4, under the condition that the sealing portion C and the spacer 21 are maintained in the preliminarily locked state to the connector housing B, which causes the electrical wire sustaining portion 10 to deflect due to the pressure of the electrical contact portion 22 of the terminal metal fitting D. As the terminal metal fitting D is inserted while the electrical wire sustaining portion 10 deflects, the projection 9 deflects due to the pressure of the electrical contact portion 22. Then, the terminal metal fitting D advances until a shoulder 22*a* of the electrical contact portion 22 engages a locking projection 3*a* of the resilient locking arm 3.

As described above, the terminal metal fitting D is inserted while maintaining the sealing portion C and the spacer 21 in preliminarily locked state to the connector housing B, so that the waterproof plug 5 does not contact the sealing face 4*a* of the accommodating chamber 4. As a result, the waterproof plug 5 is maintained to be stretchable, which reduces a force for inserting the terminal metal fitting D in comparison with the conventional waterproof connector and prevents the damage caused by the insertion of the terminal metal fitting D.

Figure 6:
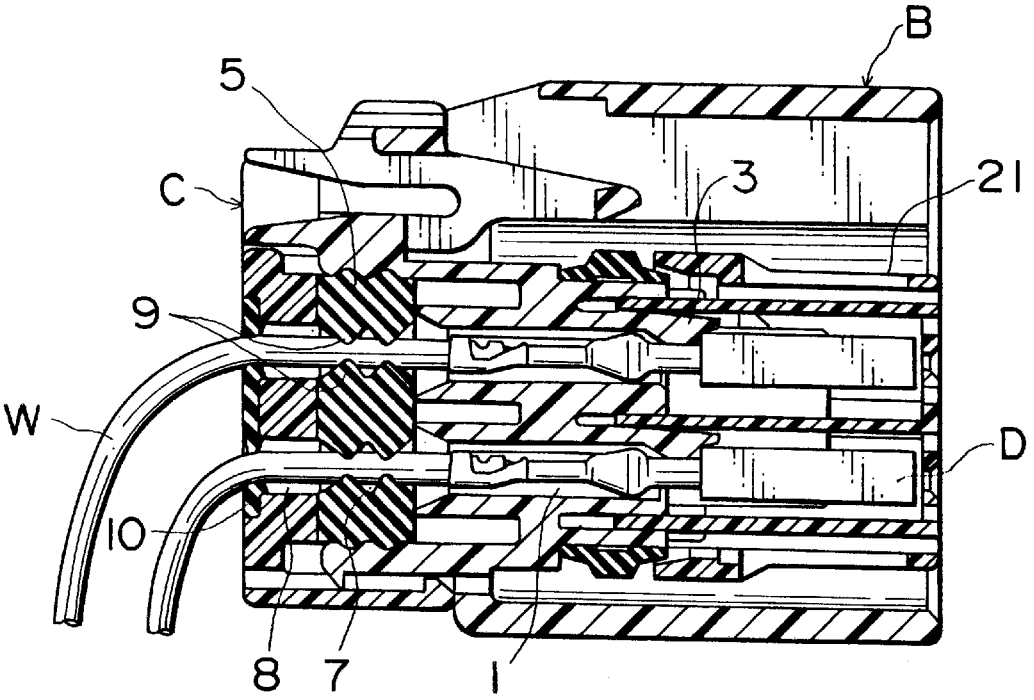
FIG. 6 is a view for explaining a condition that the sealing portion is completely locked to the connector housing.
Figure 7:
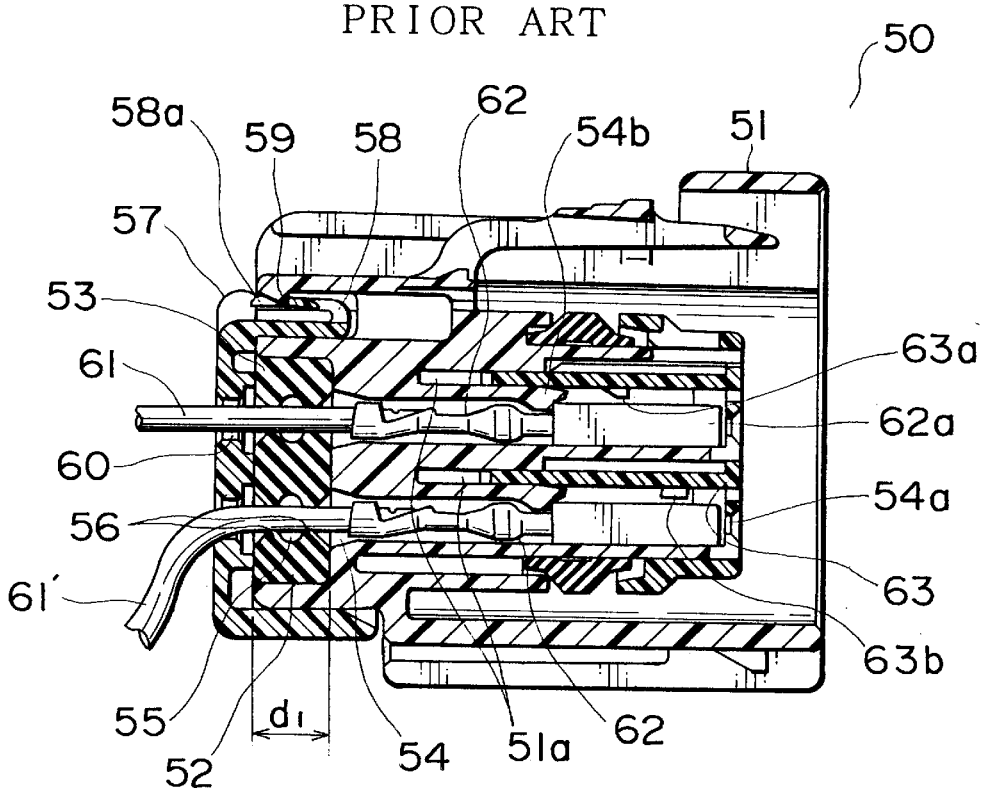
FIG. 7 PRIOR ART
FIG. 7 is a cross-sectional view of a conventional waterproof connector with a wide waterproof plug.
Figure 8:
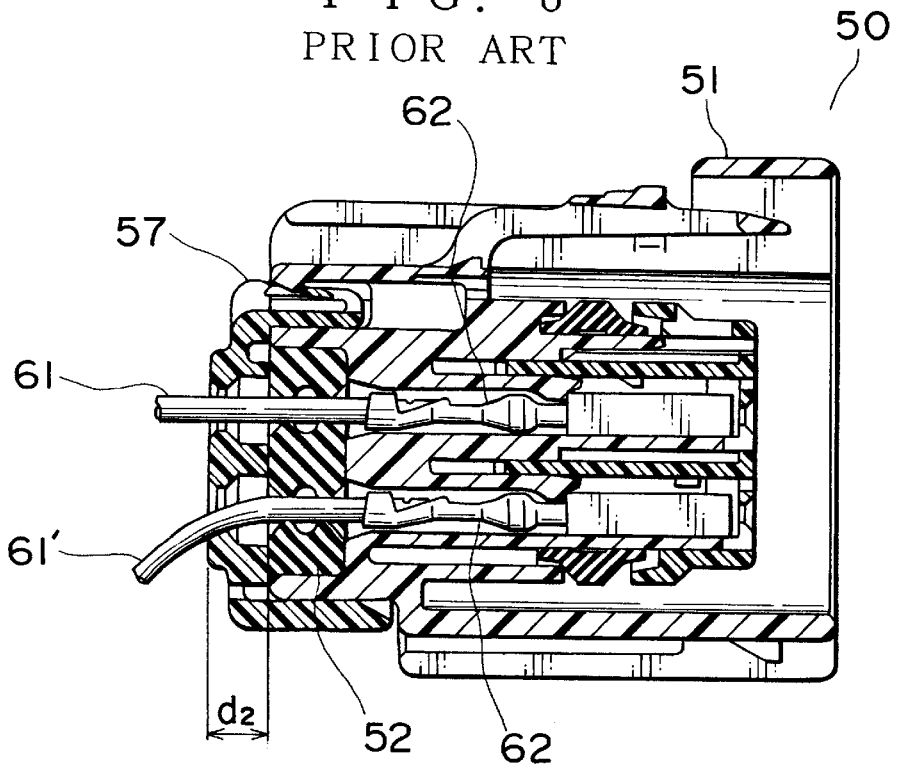
FIG. 8 PRIOR ART
FIG. 8 is a cross-sectional view of a conventional waterproof connector with a wide plug cover.

Finally, as illustrated in FIG. 6, the sealing portion C and the spacer 21 are pressed to obtain completely locked state to the connector housing B. Then, the deflection of the resilient locking arm 3 is restricted by the spacer 21, and portions around an opening 21*a* which are formed at the end of the spacer 21 contact the electrical contact portion 22 to securely fix the terminal metal fitting D to the terminal accommodating cavity 1. At the same time, the sealing portion C engages the connector housing B through locking means not shown. In this condition, the waterproof plug 5 of the sealing portion C is compressed by the sealing face 4*a*, so that the waterproofness between the electrical wire W and the sealing through hole 7 is further improved.

In the manner described above, the terminal metal fitting D is inserted into the waterproof connector A, and the electrical wire W and the electrical wire sustaining portion 10 are in close contact with each other, so that the waterproofness at the sealing portion C is improved. As a result, even if tension is generated due to the bending of the electrical wire W for instance, the electrical wire sustaining portion 10 is made of rubber resilient member, and therefore, the tension is mitigated by the electrical wire sustaining portion 10 and the sealing portion C is not affected by the tension.

As described above, with the waterproof connector according to the present invention, a waterproof plug and the plug cover are integrally formed with each other to prevent the waterproof plug from being dropped off, so that a fear of the dropping of the waterproof plug is removed, resulting in improved reliability to the waterproof connector. Further, an electrical wire sustaining portion, which is formed on the inner peripheral surface of a through hole, deflects when a terminal metal fitting passes, and the electrical wire sustaining portion sustains and fixes the wire after the passing, so that even if tension is generated due to the bending of the wire for example, the tension is mitigated by the sustaining portion. As a result, the tension is not applied to the sealing portion, therefore, the provision of the electrical wire sustaining portion to the through hole only improves the waterproofness at the sealing portion with ease and with certainty.

Further, in the preliminarily locked state of the sealing portion, the terminal metal fitting easily advances into a terminal accommodating cavity after passing through the electrical wire sustaining portion and the waterproof plug, which reduces a force for inserting the terminal metal fitting into the terminal accommodating cavity in comparison to a conventional waterproof connector. As a result, a force for pressing the waterproof plug by the terminal metal fitting when the terminal metal fitting passes through the waterproof plug, preventing the damage of the waterproof plug. Further, the sealing portion is completely locked to further improve the waterproofness between the wire, which is contactpressed to the terminal metal fitting, and the sealing through hole.

Still further, when the electrical wire sustaining portion is formed to be a row of projection which is formed around and near an inlet of the through hole, the electrical wire is securely in contact with the tip of the projection, therefore, even if tension is generated by the bending of the electrical wire for example, the projection allows the tension to further be mitigated, resulting in further improvement of the waterproofness at the sealing portion.

In addition to the above, the formation of water extractor at the electrical wire sustaining portion permits the water and the like to securely be discharged from the electrical wire sustaining portion to outside, even if the water and the like invade the through hole, so that it becomes unnecessary to worry the invasion of water and the like to the through hole, resulting in improved reliability to the waterproof connector.

Further, due to the integral formation of the waterproof plug and the plug cover, it is possible to provide the wire sustaining portion while utilizing the shape for preventing the waterproof plug from being dropped off and for controlling the fluidity of injected rubber, so that the waterproof connector can be formed without making the dimension and weight of a connector housing and the plug cover larger and heavier.

What is claimed is:

1. A waterproof connector comprising:

a housing;

a plurality of terminal accommodating cavities in said housing;

a waterproof plug with a plurality of sealing through holes at positions corresponding to those of said plurality of terminal accommodating cavities;

a plug cover integrally formed with said waterproof plug to form a sealing portion in combination with said waterproof plug, said plug cover having a plurality of through holes at positions corresponding to those of said plurality of sealing through holes of said waterproof plug, said plug cover to be mounted to said housing; and an electrical wire sustaining portion with resilience on an inner peripheral surface of each of said through holes of the plug cover.

2. The waterproof connector as claimed in claim 1, further comprising:

a preliminary locking means for preliminarily locking said sealing portion to said housing, and a terminal metal fitting is inserted into and fixed to said terminal accommodating cavity after passing through said sealing through hole of the waterproof plug and said through hole of plug cover under a condition that the sealing portion is preliminarily locked to the housing.

3. The waterproof connector as claimed in claim 2, wherein said preliminary locking means comprising: a locking arm with a first locking projection at a tip thereof; and a second locking projection formed on said sealing portion, said second locking projection to be engaged with said first locking projection when the sealing portion is preliminarily locked to the housing.

4. The waterproof connector as claimed in claim 2, further comprising a spacer for fixing said terminal metal fitting to said terminal accommodating cavity, said spacer preliminarily locked to said housing before said terminal metal fitting is inserted into the terminal accommodating cavity.

5. The waterproof connector as claimed in claim 1, wherein said electrical wire sustaining portion includes, for each through hole, a peripheral projection which projects inwardly in said through hole in the vicinity of an inlet of said through hole.

6. The waterproof connector as claimed in claim 1, wherein said electrical wire sustaining portion has a water extractor extending in a direction that the terminal metal fitting is inserted into said through hole.

* * * * *